United States Patent [19]

Rossi et al.

[11] Patent Number: 4,761,221

[45] Date of Patent: Aug. 2, 1988

[54] PROCESS FOR THE DECOMPOSITION OF HALOGENATED ORGANIC COMPOUNDS

[75] Inventors: Carmela A. Rossi, Dampremy; Philippe Nelis, Mont Saint-Guibert, both of Belgium

[73] Assignee: Labofina, S.A., Brussels, Belgium

[21] Appl. No.: 32,500

[22] Filed: Mar. 31, 1987

[30] Foreign Application Priority Data

Apr. 30, 1986 [FR] France ..... 86 06252

[51] Int. Cl.[4] ..... C10G 29/04

[52] U.S. Cl. ..... 208/262; 585/469; 210/909; 423/240

[58] Field of Search ..... 208/262; 210/909; 423/240; 585/469

[56] References Cited

U.S. PATENT DOCUMENTS

| | | | |
|---|---|---|---|
| 2,164,334 | 7/1939 | Marks | 208/262 |
| 3,539,653 | 11/1970 | Fevel et al. | 208/262 |
| 4,284,516 | 8/1981 | Parker et al. | 210/59 |
| 4,327,027 | 4/1982 | Howard et al. | 568/755 |
| 4,337,368 | 6/1982 | Pytlewski et al. | 585/802 |
| 4,351,718 | 9/1983 | Bruenelle | 208/262 |
| 4,400,566 | 8/1983 | Colon | 585/469 |
| 4,417,091 | 11/1983 | Gaillard | 208/262 |
| 4,417,977 | 11/1983 | Pytlewski et al. | 208/262 |
| 4,430,208 | 2/1984 | Pytlewski et al. | 585/469 |
| 4,447,262 | 5/1984 | Gay et al. | 210/909 |
| 4,602,994 | 7/1986 | Pytlewski et al. | 208/262 |
| 4,618,686 | 10/1986 | Boyer | 585/469 |
| 4,623,448 | 11/1986 | O'Connell et al. | 208/262 |
| 4,639,309 | 1/1987 | Lalancetle et al. | 208/262 |

*Primary Examiner*—Helen M. S. Sneed
*Assistant Examiner*—Helane Myers
*Attorney, Agent, or Firm*—John K. Abokhair; Roger Parkhurst; Mark A. Montgomery

[57] ABSTRACT

A process for the decomposition of a halogenated organic compound which comprises contacting the compound with a polyglycol and an alkali or alkaline-earth hydride, optionally in the presence of an alkali salt, at a temperature which does not exceed 100° C., and under an atomosphere having a reduced oxygen content.

The process is particularly useful for the decontamination of industrial oils containing chlorinated biphenyls because the treated oil is not degraded during the decontamination process.

30 Claims, No Drawings

PROCESS FOR THE DECOMPOSITION OF HALOGENATED ORGANIC COMPOUNDS

TECHNICAL FIELD

This invention relates to a process for the decomposition of halogenated organic compounds, especially polyhalogenated organic compounds, such as chlorinated paraffins, polychlorinated biphenyls (hereinafter PCB), polychlorinated terphenyls and the brominated and fluorinated homologues. The invention also relates to a method for the decontamination of mineral oils containing PCB and/or other polluting polyhalogenated organic compounds.

BACKGROUND OF THE INVENTION

Many halogenated organic compounds soluble in fatty materials, exhibit high chemical stability and are resistant to biodegradation. Consequently, there is an increase of their concentration in the food chain. Several studies have clearly shown the intrinsic toxicity of these compounds and also their potential toxicity during a thermal treatment. When heated at a temperature from 300° to 900° C. in the presence of air, PCB produce dioxins and benzofurans some isomers of which are still more toxic.

For these reasons, several institutions for environmental protection have promulgated strict regulations concerning the use of commercial compositions containing halogenated organic compounds. These regulations impose strict controls on industrial oils which have a high likelihood of PCB contamination. These fluids are classified according to their contamination level. The U.S. Environmental Protection Agency has promulgated rules under which PCB-containing oils can be broken down into the following categories:

PCB-free oils: oils containing less than 50 ppm PCB;

PCB-contaminated oils: oils containing 50–500 ppm PCB;

PCB-oils: oils containing more than 500 ppm PCB.

PCB have been largely used as dielectric fluids in transformers and condensers, in lubricating oils, heat-transfer fluids, and also as additives in glues, paints, asphalts, synthetic resins, fibers, and coatings, etc. However, despite this wide range of application, the electrical industry is the main source of contamination by PCB.

Oils containing more than 50 ppm PCB may be eliminated by burning in high temperature incinerators, but the latter must meet several strict conditions. Therefore, the treatment cost is high. Moreover, the valuable oil is completely destroyed and lost.

Physical methods, such as distillation, extraction by selective solvent and adsorption by charcoal, may also be used for the elimination of PCB from mineral oils. However, PCB are not destroyed by these methods. The problem is not how to eliminate PCB from oils, but how to destroy these PCB.

It is, therefore, important to develop a method for the chemical destruction of halogenated organic compounds by cleavage of the carbon-halogen bond.

Several chemical methods have already been suggested for the decontamination of mineral oils containing polyhalogenated aromatic compounds. The PCB content of an oil may be decreased by treating said oil with solid sodium or with a dispersion of sodium in a liquid hydrocarbon. However, the yields are low, even at high temperatures where the intrinsic properties of the treated oil are greatly damaged. Another process consists of using a sodium-naphthalene or sodium-biphenyl complex in a suitable solvent, such as diethylether. This process has two main drawbacks: first, the handling of sodium is dangerous and, second, it is difficult to separate the oil and the reagents after the treatment step.

It has also been suggested to employ a technique which consists of contacting the mineral oil with an alkali metal glycolate which has been previously prepared from a polyglycol and an alkali metal or its hydroxide. The reaction with the oil must be carried out in the absence of oxygen and at an elevated temperature (about 130° C.) in order to achieve good yields. However, the oil is degraded at this temperature (U.S. Pat. Nos. 4,337,368; 4,353,793; 4,400,552 and 4,460,797; European Patent Application No. 60089).

Other processes for the decontamination of mineral oils containing halogenated aromatic compounds consist of using alkali alkoxides in the presence of a solvent, such as a sulphoxide. But, once more, the reaction temperatures are elevated. Moreover, an additional step is required to separate the solvent and the treated oil.

According to another process, the mineral oil is treated with a reagent mixture prepared from a polyether, a free-radical generating compound, such as a peroxide, and a weak base (European Patent Application 118858). A preliminary step is required to prepare the reagent mixture. Furthermore, the decontamination reaction must be carried out with the aid of microwaves to reduce the reaction time.

There is thus a need in the art for a process for the chemical decomposition of halogenated organic compounds which achieves high yields using a reagent which does not require a preliminary preparation step.

SUMMARY OF THE INVENTION

Accordingly, it is an object of the present invention to provide a new and improved method for the chemical decomposition of halogenated organic compounds at moderate reaction temperatures.

It is an additional object of the invention to provide a method for the decontamination of mineral oils containing halogenated organic compounds without degradation of the treated oil.

The process of this invention for the chemical decomposition of halogenated organic compounds comprises contacting said compounds with a polyglycol and an alkali or alkaline-earth hydride, under an atmosphere having a low oxygen content.

According to an embodiment of this invention, the process is applied to the decontamination of mineral oils containing halogenated organic compounds. This embodiment comprises contacting the mineral oil with a polyglycol and an alkali or alkaline-earth hydride, under an atmosphere having a low oxygen content.

DETAILED DESCRIPTION OF THE INVENTION

The chemical decomposition of halogenated organic compounds is carried out using reagents comprising a polyglycol and a hydride.

The polyglycol has the general formula $HO\text{-}[\text{-}RO]_nH$, wherein R is the alkyl radical $-CH_2CH_2-$ and/or $-CH_2CH(CH_3)-$ and n is an integer between 2 and 500. These polyglycols may be polyethyleneglycols, polypropylene glycols, mixtures thereof and copolymers of ethylene oxide and propylene oxide. These compounds may be liquid or solid, depending on their molecular weight. Solid polyglycols having a low melting point and a molecular weight equal to or greater than 1000 are preferably used.

The second reagent is a metal hydride, more particulary an alkali hydride, such as sodium, lithium or potassium hydride, or an alkaline-earth hydride, such as calcium hydride. The choice of the hydride depends upon its price, availability and its reactivity for the dehalogenation reaction. For these reasons, it is advantageous to employ sodium hydride which is commercially available, either as a dispersion in a mineral oil, or as a product embedded in paraffin (hydride content: 80%).

In order to achieve an efficient dehalogenation, it is preferrable to separately add the polyglycol and the hydride to the product to be treated, rather than to blend these reagents before the dehalogenation reaction. According to a preferred embodiment, the polyglycol is first added to the product to be treated and the hydride is thereafter added.

The process of this invention may be carried out using a reactor provided with stirring means for intimate contact between the treated product, the polyglycol and the hydride. The product to be treated is dehydrated and introduced into the reactor. The liquid or solid polyglycol and thereafter the hydride are then added. The oxygen content in the reactor is reduced, either by working under vacuum, or by introducing an inert gas such as nitrogen.

The dehalogenation reaction is carried out with stirring and at a temperatire between 20° C. and 100° C.

The amount of hydride depends upon the halogen content of the treated product. The amount of alkali or alkaline-earth hydride at least equals the stoichiometric amount required to react with the halogen ions of the treated product to form the corresponding alkali or alkaline-earth halide. Generally, the hydride will be used in an amount between 1 and about 20 times the stoichiometric amount. The skilled worker may easily determine the halogen content of the organic matter contained in the product to be treated and, from this content, he can determine the amount of hydride to be used.

The amount of polyglycol may vary between wide limits, as it depends on the molecular weight of the polyglycol, the physical nature of the treated product and the type of hydride employed. Valuable results have been obtained by using an amount of polyglycol which is as low as 0.1%, based on the weight of treated product, especially when the latter is a PCB-contaminated oil. The amount of polyglycol may reach and even exceed 100 weight %, based on the weight of the treated product. Generally, the amount of polyglycol will be between about 0.1 and 20 weight % for the treatment of a mineral oil containing up to 10% PCB.

The dehalogenation reaction may be carried out at room temperature. However, the reaction rate is increased by working at a temperature of at least 50° C., but lower than 100° C. In case of treatment of a light mineral oil containing PCB, the reaction temperature is therefore lower than the flash point of said oil.

According to an embodiment of the process of this invention for the treatment of a PCB-containing oil, the decontamination of the previously dehydrated oil is carried out by contacting the oil first with a solid or liquid polyglycol and then with an alkali hydride, more particularly sodium hydride, at a temperature in the range of 60° to 95° C. under vacuum or under a nitrogen atmosphere. The dechlorination level is controlled by withdrawing samples of the reaction mixture. The samples are cooled and after decantation, filtration or centriguration and optional washing with water, their chlorine content is determined by X-rays and titrimetry. The PCB are dechlorinated by this process with formation of NaCl and biphenyls or corresponding polymers.

The process of this invention provides an efficient method for the decontamination of PCB-containing mineral oils at a temperature which does not exceed 100° and which reagents which do not require a preliminary preparation step. The reaction time is relatively short and the dechlorination rate is particularly high. The decontaminated oil is easily recovered and its dielectric properties are not degraded. The process is safe, easily applied and it may be a continuous or a batch process.

Many modifications and variations may be made to the hereinabove described process, without departing from the scope of this invention. By way of example, the dehalogenation reaction may be activated by adding an alkali metal salt of a halogen-free organic or inorganic acid to the reaction mixture. Examples of these alkali salts include the alkali carbonates, bicarbonates, phosphates, oxalates, citrates, acetates and mixtures thereof. The choice of the salt depends mainly on its price and for this reason sodium or potassium carbonate or bicarbonate are preferably used.

Particularly interesting results are obtained when the halogenated organic compound or a composition containing such a compound is first treated with polyglycol, then with an alkali salt and thereafter with a hydride. The amount of alkali salt may be as low as 0.5 and may reach 20%, by weight based on the total amount of polyglycol and hydride. Generally, this amount will be between about 1 and 10% by weight.

The following examples illustrate the effectiveness of the process of this invention.

EXAMPLE 1

A reactor provided with a stirrer and heating means was charged with 100 g of a contaminated mineral oil containing 850 ppm PCB. Polyethyleneglycol having a molecular weight of 1000 was first added in an amount of 5%, based on the weight of oil. Sodium hydride embedded in paraffin (80% of hydride) was then added in an amount of 0.4%, based on the weight of the oil. This corresponds to 10 times the stoichiometric amount. The reaction was carried out under nitrogen and the reaction mixture was stirred at a temperature of 85° C.

After 80 minutes, the decomposition yield of the PCB contained in the oil was greater than 96%.

Comparative experiment A:

The procedure of Example 1 was repeated except that the polyethyleneglycol and hydride were added as a previously prepared blend of polyethyleneglycol and hydride.

After 2 hours at 85°, the decomposition yield of the PCB was only 80%.

Comparative experiment B:

The procedure of Example 1 was repeated, except the reaction was run in the presence of air.

The decontamination yield did not exceed 30%.

EXAMPLE 2

The procedure of Example 1 was repeated to treat an oil which had been used in a transformer and which contained 480 ppm of chlorine due to chlorinated organic compounds.

The respective amounts of polyethyleneglycol (molecular weight: 1000) and sodium hydride were 5% and 0.4%, these percentages being based on the weight of the treated oil.

After 80 minutes, the oil was completely decontaminated.

The resulting oil was less coloured than the starting oil and its tangent delta was $2.98\times10^{-3}$.

EXAMPLE 3

The procedure of Example 1 was repeated to treat an industrial oil containing 50,000 ppm PCB.

The respective amounts of polyethyleneglycol (molecular weight: 1000) and sodium hydride were 20% and 1.6%, these percentages being based on the weight of the treated oil.

After 14 hours at 85° C., the treated oil was decontaminated.

EXAMPLE 4

To an oil (100 g) containing 1000 ppm chlorinated paraffins were added successively 5 g polyethyleneglycol (molecular weight: 1000), 0.4 g sodium hydride and 0.4 g potassium carbonate.

The dechlorination reaction was carried out under vacuum, at 100° for 3 hours.

The decontamination yield was greater than 99%.

EXAMPLE 5

The procedure of Example 4 was repeated, except that 0.7 g potassium hydride was substituted for the sodium hydride.

The oil was decontaminated after the treatment.

EXAMPLE 6

To 100 g of industrial oil containing 1000 ppm trichlorobenzene were added one after another 10 g polyethyleneglycol (molecular weight: 1000), 0.8 g sodium hydride and 0.8 g potassium carbonate.

After 3 hours under vacuum, at 100°, the oil was decontaminated.

EXAMPLE 7

Experiments were carried out for the treatment of an industrial oil containing 870 ppm PCB. In each experiment, 100 g oil was treated with 5 g polyethyleneglycol, 0.4 g sodium hydride and 0.4 g potassium carbonate, under vacuum and at a temperature between 85° C. and 90° C. The purpose of these experiments was to obtain comparative results and for this reason the reaction time was limited to 80 minutes.

Table 1 gives the dechlorination yield as a function of the molecular weight of the employed polyethyleneglycol.

TABLE 1

| Molecular weight of the polyethyleneglycol | Dechlorination yield (%) |
|---|---|
| 1000 | 70 |
| 2000 | 62 |
| 4000 | 58 |

EXAMPLE 8

The procedure of Example 7 was repeated using different alkali salts. The polyethyleneglycol had a molecular weight of 1000.

The obtained results are given in Table 2.

TABLE 2

| Alkali Salt | Dechlorination yield (%) |
|---|---|
| potassium carbonate | 70 |
| sodium bicarbonate | 58 |
| potassium acetate | 53 |
| potassium oxalate | 26 |
| sodium phosphate | 57 |

What is claimed is:

1. A process for the decomposition of a halogenated organic compound which comprises contacting said halogenated organic compound with a polyglycol and a hydride selected from the group consisting of alkali and alkaline-earth hydrides, under an atmosphere having a low oxygen content and at a temperature which does not exceed 100° C.

2. A process according to claim 1, wherein the temperature is from about 60° C. to about 90° C.

3. A process according to claim 1, wherein the halogenated organic compound is first contacted with the polyglycol and then with the hydride.

4. A process according to claim 3, wherein the polyglycol is used in a amount of between 0.1 and 100%, based on the weight of halogenated organic compound.

5. A process according to claim 4, wherein the polyglycol is selected from the group consisting of liquid and low-melting solid polyglycols having the general formula $HO\{-RO\}_nH$, wherein R is the radical $-CH_2CH_2-$, $-CH_2CH(CH_3)-$, or mixtures thereof, and n is an integer of between 2 and 500.

6. A process according to claim 5, wherein the polyglycol has a molecular weight of at least 1000.

7. A process according to claim 3, wherein the hydride is used in an amount of between 1 and 20 times the stoichiometric amount required to react with the halogen ions of the halogenated organic compound.

8. A process according to claim 1, wherein the halogenated organic compound is contacted with the polyglycol and the hydride in the presence of an alkali salt of a halogen-free acid.

9. A process according to claim 8, wherein the alkali salt is selected from the group consisting of alkali carbonates, bicarbonates, phosphates, acetates, citrates, oxalates and mixtures thereof.

10. A process according to claim 8, wherein the alkali salt is used in an amount of between 0.5 and 20%, based on the total weight of polyglycol and hydride.

11. A process according to claim 8, wherein the halogenated organic compound is first contacted with the polyglycol, then with the alkali salt and thereafter with the hydride.

12. A process according to claim 1, wherein the halogenated organic compound is a polyhalogenated aromatic compound.

13. A process according to claim 12, wherein the polyhalogenated aromatic compound is a polychlorinated biphenyl.

14. A process according to claim 1, wherein the halogenated organic compound is in solution in an industrial oil.

15. A process for the decontamination of an industrial oil containing a halogenated organic compound, which comprises contacting said oil with a polyglycol and a hydride selected from the group consisting of alkali and alkaline-earth hydrides, under an atmosphere having a low oxygen content and at a temperature which does not exceed 100° C.

16. A process according to claim 15, wherein the temperature is from about 60° C. to about 90° C.

17. A process according to claim 15, wherein the oil is first contacted with the polyglycol and then with the hydride.

18. A process according to claim 17, wherein the polyglycol is used in an amount of between about 0.1 and about 20%, based on the weight of the oil.

19. A process according to claim 18, wherein the polyglycol is selected from the group consisting of liquid and low-melting solid polyglycols having the general formula $HO\text{-}[\text{-}RO]_n\text{-}H$, wherein R is the radical $-CH_2CH_2-$, $-CH_2CH(CH_3)-$, or mixtures thereof, and n is an integer between 2 and 500.

20. A process according to claim 19, wherein the polyglycol has a molecular weight of at least 1000.

21. A process according to claim 17, wherein the hydride is used in an amount of from 1 to 20 times the stoichiometric amount required to react with the halogen ions of the halogenated organic compound.

22. A process according to claim 15, wherein the halogenated organic compound is contacted with the polyglycol and the hydride in the presence of an alkali salt of a halogen-free acid.

23. A process according to claim 22, wherein the alkali salt is selected from the group consisting of alkaline carbonates, bicarbonates, phosphates, acetates, citrates, oxalates and mixtures thereof.

24. A process according to claim 22, wherein the alkali salt is used in an amount of between 0.5 and 20%, based on the total weight of polyglycol and hydride.

25. A process according to claim 22, wherein the oil is first contacted with the polyglycol, then with the alkali salt and thereafter with the hydride.

26. A process according to claim 15, wherein the halogenated organic compound is a polyhalogenated aromatic compound.

27. A process according to claim 26, wherein the polyhalogenated aromatic compound is a polychlorinated biphenyl.

28. A process for the decontamination of industrial oil containing a halogenated organic compound, which comprises contacting said oil under an atmosphere having a low oxygen content and at a temperature between about 20° and 100° C. with (a) a polyglycol in an amount between about 0.1 and 20 based on the weight of the oil, followed by (b) contacting said oil with a hydride selected from the group consisting of alkali and alkaline-earth hydrides, wherein the amount of hydride is from about 1 to 20 times the stoichiometric amount required to react with the halogen ions of the halogenated organic compound.

29. The process according to claim 28 wherein the halogenated organic compound is a polychlorinated biphenyl, the hydride is sodium hydride, the atmosphere having a low oxygen content is nitrogen, and the temperature is between about 60° C. to 90° C.

30. A process according to claim 29 wherein the polychlorinated biphenyl is first contacted in the oil with the polyglycol, then with an alkali salt of a halogen-free acid, and thereafter with sodium hydride.

* * * * *